US010247058B2

(12) United States Patent
Jang et al.

(10) Patent No.: US 10,247,058 B2
(45) Date of Patent: Apr. 2, 2019

(54) APPARATUS AND METHOD OF ADJUSTING VALVE TIMING FOR INTERNAL COMBUSTION ENGINE

(71) Applicants: Delphi Powertrain Systems Korea Ltd., Changwon-si, Gyeongsangnam-do (KR); Pine Engineering Ltd., Changwon-si, Gyeongsangnam-do (KR)

(72) Inventors: KounYoung Jang, Changwon-si (KR); Sung Dae Kim, Changwon-si (KR); Sang Ho Lee, Changwon-si (KR); Jae Young Kang, Changwon-si (KR); Sung Hoon Baek, Gimhae-si (KR); Soo Deok Ahn, Changwon-si (KR)

(73) Assignees: Delphi Powertrain Systems Korea Ltd., Changwon-si (KR); Pine Engineering Ltd., Changwon-si (KR)

( * ) Notice: Subject to any disclaimer, the term of this patent is extended or adjusted under 35 U.S.C. 154(b) by 149 days.

(21) Appl. No.: 15/458,929

(22) Filed: Mar. 14, 2017

(65) Prior Publication Data

US 2017/0211432 A1 Jul. 27, 2017

(30) Foreign Application Priority Data

Jan. 26, 2016 (KR) ..... 10-2016-0009545

(51) Int. Cl.

| | |
|---|---|
| ***F01L 1/34*** | (2006.01) |
| ***F01L 1/344*** | (2006.01) |
| ***F01L 1/047*** | (2006.01) |

(52) U.S. Cl.

CPC ..... *F01L 1/3442* (2013.01); *F01L 1/047* (2013.01); *F01L 1/34409* (2013.01); (Continued)

(58) Field of Classification Search

CPC ..... F01L 1/047; F01L 1/3442; F01L 1/34409; F01L 2001/3443; F01L 2001/34453; (Continued)

(56) References Cited

U.S. PATENT DOCUMENTS 7,444,971 B2 * 11/2008 Suga ..... F01L 1/34 123/90.15
2010/0313835 A1 * 12/2010 Yamaguchi ..... F01L 1/3442 123/90.15

FOREIGN PATENT DOCUMENTS

JP 2000002104 1/2000
JP 2001050016 2/2001
(Continued)

*Primary Examiner* — Zelalem Eshete
(74) *Attorney, Agent, or Firm* — Lee, Hong, Degerman, Kang & Waimey

(57) ABSTRACT

Disclosed is an apparatus of adjusting valve timing for internal combustion engine configured to adjust at least one valve timing of an intake valve and an exhaustive valve by torque of a cam shaft and pressure of working fluid, and a method thereof. The method of the present disclosure is such that a rotor is embedded with a hydraulic control valve configured to operate a locking pin member, and the hydraulic control valve is so configured as to have various control positions in order to supply or discharge working fluid in response to engine emergency stop or start and normal engine operational state whereby locking and releasing operations are realized with accurate responsiveness and reliability due to smaller working fluid through a passage and an engine performance can be improved by adjusting the valve timing.

20 Claims, 5 Drawing Sheets

(52) U.S. Cl.
CPC ..... *F01L 2001/3443* (2013.01); *F01L 2001/34433* (2013.01); *F01L 2001/34453* (2013.01); *F01L 2001/34463* (2013.01); *F01L 2001/34469* (2013.01); *F01L 2250/02* (2013.01); *F01L 2250/04* (2013.01)

(58) Field of Classification Search
CPC ... F01L 2001/34433; F01L 2001/34463; F01L 2001/34469; F01L 2250/02; F01L 2250/04
See application file for complete search history.

(56) References Cited

FOREIGN PATENT DOCUMENTS

| | | |
|---|---|---|
| JP | 2002357105 | 12/2002 |
| JP | 2010285986 | 12/2010 |
| KR | 1020150185229 | 12/2015 |
| KR | 1020160001689 | 1/2016 |

* cited by examiner

APPARATUS AND METHOD OF ADJUSTING VALVE TIMING FOR INTERNAL COMBUSTION ENGINE

Pursuant to 35 U.S.C. § 119 (a), this application claims the benefit of earlier filing date and right of priority to Korean Patent Application No. 10-2016-0009545, filed on Jan. 26, 2016, the contents of which are hereby incorporated by reference in their entirety.

BACKGROUND OF THE DISCLOSURE

Field

The teachings in accordance with the exemplary embodiments of this disclosure relate generally to an apparatus of adjusting valve timing for internal combustion engine and a method thereof, and more particularly to an apparatus of adjusting valve timing for internal combustion engine configured to improve engine performance by increasing reliability of locking operation and a method thereof.

Background

In general, an apparatus of valve timing adjusting (hereinafter referred to as "apparatus of adjusting valve timing, or simply as "apparatus") has been used that is capable of changing a timing of an intake valve or an exhaust valve in response to operation state of an internal combustion engine (hereinafter referred to as "engine"). The valve timing adjusting apparatus changes a timing of intake valve or exhaust valve by changing a displacement angle or a rotation phase of a cam shaft interacting with a crank shaft via a timing belt or a chain, and various types of apparatuses are proposed.

In general, vane type valve timing adjusting apparatuses including a rotor having a plurality of vanes, e.g., three or four vanes freely rotated inside a housing by working fluid, are largely used. Among these apparatuses, a valve timing adjusting apparatus, i.e., an intermediate phase valve timing adjusting apparatus, is largely used in terms of efficiency aspect, where an engine is started by interaction with a crank shaft while a cam shaft is locked using a locking pin when the cam shaft is positioned at an intermediate position between a full advance phase angle and a full retard phase angle relative to the crank shaft.

Meantime, the locking method of using the locking pin may be categorized into a method using a hydraulic ratchet operated by oil, and a method using a mechanical ratchet. The hydraulic ratchet method is complicated in flow path albeit being small in oil consumption, while the mechanical ratchet method is widely used because of being simple in structure albeit being of more consumption in oil than the hydraulic ratchet method.

For example, the Japanese laid open patent No. 2001-50016 discloses a valve timing adjusting apparatus configured to prevent generation of noise and to quickly start an engine at an intermediate position, and the Japanese laid open patent No. 2000-2104 discloses a valve timing adjusting apparatus configured to prevent generation of noise. Furthermore, the Japanese laid open patent No. 2002-357105 discloses a valve timing adjusting apparatus having two locking pins in which the locking pin is divided to one pin controlling a retard phase angle operation and another pin controlling an advance phase angle.

The valve timing adjusting apparatus mentioned above is of an external-mounting type structure in which a hydraulic control valve to adjust a flow direction of working fluid supplied to a rotor is mounted on a cylinder head in order to increase or delay the timing of intake valve or exhaust valve.

Meantime, the external-mounting type valve timing adjusting apparatus suffers from disadvantages in that flow resistance to flow of working fluid may be generated or leakage may be generated due to lengthened distance between the hydraulic control valve and the valve timing adjusting apparatus mounted with a rotor inside a housing, whereby responsiveness of the valve timing adjusting apparatus is reduced by pressure decrease in the working fluid. Another disadvantage is that a hydraulic pressure circuit for arranging a hydraulic control valve on a cylinder head becomes complicated.

On top of that, when an intermediate phase valve timing adjusting apparatus is applied to the external-mounting type structure, an additional control valve or a hydraulic pressure circuit may be required in certain cases in order to control the operation of locking pin, which adds the complexity of design to configuration and operation.

In order to solve the aforementioned disadvantages, an internal-mounting (center feed) type valve timing adjusting apparatus, in which a hydraulic control valve is integrally mounted inside a fixing bolt of a rotor, has been developed, which is compact in the entire configuration of valve timing adjusting apparatus and simple in external piping as well.

For example, the Japanese Laid-open patent No. 2010-285986 discloses a valve timing adjusting apparatus capable of quickly adjusting valve timing by improving an operational structure of hydraulic control valve. However, the valve timing adjusting apparatus of the Japanese Laid-open patent No. 2010-285986 also suffers drawbacks in that although a bad influence, in which surging of working fluid affects the locking operation, can be removed to allow a quick control of valve timing, configuration of rotor becomes complicated due to structure of employing two locking pins, and improved reliability of operation is limited due to increased number of component parts.

Thus, various valve timing adjusting apparatuses for internal combustion engine have been developed that can improve an engine performance by efficiently adjusting a valve timing while locking and releasing operations with good responsiveness and high reliability can be realized using a simple configuration.

The present applicant has proposed a valve timing adjusting apparatus of an internal combustion engine through Korean patent application Nos.: 10-2015-0185229 and 10-2016-0001689, and therefore, it is preferable that development of a hydraulic control technique be required in order to improve responsiveness of operation and increase reliability for a valve timing adjusting apparatus.

SUMMARY OF THE DISCLOSURE

The present disclosure has been made to solve the foregoing disadvantages of the prior art and therefore an object of certain embodiments of the present disclosure is to provide a valve timing adjusting apparatus for internal combustion engine configured to improve engine performance by realizing highly reliable locking and releasing operations by employing a configuration with less working fluid loss.

Another object is to provide a valve timing adjusting method for internal combustion engine configured to improve engine performance by realizing highly reliable locking and releasing operations with accurate responsiveness.

Technical subjects to be solved by the present disclosure are not restricted to the above-mentioned description, and any other technical problems not mentioned so far will be clearly appreciated from the following description by the skilled in the art.

An object of the discloser is to solve at least one or more of the above problems and/or disadvantages in whole or in part and to provide at least advantages described hereinafter. In order to achieve at least the above objects, in whole or in part, and in accordance with the purposes of the disclosure, as embodied and broadly described, and in one general aspect of the present disclosure, there is provided a valve timing adjusting apparatus for internal combustion engine, comprising: a housing having an inner space while interlocking with a crank shaft; a rotor having a plurality of vanes each forming an advance chamber in a direction of adjusting an advance phase angle and a retard chamber in a direction of adjusting a retard phase angle, each mounted at an inner space of the housing while being interlocked with the cam shaft; a locking pin member including a hollow outer pin elastically mounted at a locking chamber formed at the vane, and an inner pin elastically mounted at an inside of the outer pin, and preventing rotation of rotor by being coupled to the housing using a torque transmitted from the cam shaft while adjusting a valve timing at an intermediate position between a full advance phase angle position and a full retard phase angle position of rotor; and a hydraulic control valve mounted at an inside of the rotor to supply working fluid to or discharge the working fluid from the advance chamber, the retard chamber or a locking chamber in response to operation state of engine, and connected to a fluid pump in order to control the operation of a locking pin member.

Preferably, but not necessarily, the housing may include a plurality of locking grooves each connected at a different depth in order to allow the locking pin member to be coupled.

Preferably, but not necessarily, the locking groove may be formed with a staircase portion by allowing a large diametered groove with a large diameter and a small diametered groove with a smaller diameter to be formed each at a predetermined depth.

Preferably, but not necessarily, the apparatus may further comprise a drain passage interrupted when a phase angle adjustment of the locking pin member is operated, and discharging working fluid of the locking groove to the outside when the locking pin member is locked.

Preferably, but not necessarily, the drain passage may include a first drain hole connected to the outside through a vane, and a second drain hole connected to the locking groove by communicating with the first drain hole.

Preferably, but not necessarily, the hydraulic control valve may include a 5-port 5-position valve configured to selectively supply or discharge the working fluid through passages each connected to the advance chamber, the retard chamber and the locking chamber.

Preferably, but not necessarily, the apparatus may further comprise a check valve configured to prevent backflow between the hydraulic control valve and the fluid pump.

Preferably, but not necessarily, the outer pin may be divided into an upper ring and a bottom ring.

In another general aspect of the present disclosure, there is provided a method of adjusting valve timing for internal combustion engine including a housing having an inner space while interlocking with a crank shaft; a rotor having a plurality of vanes each forming an advance chamber in a direction of adjusting an advance phase angle and a retard chamber in a direction of adjusting a retard phase angle, each mounted at an inner space of the housing while being interlocked with the cam shaft; and a locking pin member including a hollow outer pin elastically mounted at a locking chamber formed at the vane, and an inner pin elastically mounted at an inside of the outer pin, and preventing rotation of rotor by being coupled to the housing using a torque transmitted from the cam shaft while adjusting a valve timing at an intermediate position between a full advance phase angle position and a full retard phase angle position of rotor, the method comprising: discharging the working fluid of the advance chamber, the retard chamber and the locking chamber when the engine is in a stationary state; supplying the working fluid to the advance chamber and the retard chamber and discharging the working fluid of the locking chamber during idling rotation state of the engine; and supplying the working fluid to the locking chamber and selectively supplying the working fluid to the advance chamber or to the retard chamber during a normal engine operational state.

Preferably, but not necessarily, the method may further comprise interrupting the supply of working fluid to the advance chamber and the retard chamber, and supplying the working fluid only to the locking chamber during the normal engine operational state.

Preferably, but not necessarily, the hydraulic control valve may include a 5-port 5-position valve configured to selectively supply or discharge the working fluid through passages each connected to the advance chamber, the retard chamber and the locking chamber.

Preferably, but not necessarily, locking may be implemented in such a manner that an outer pin and an inner pin are sequentially moved by a negative torque transmitted from the cam shaft during a normal engine operational state for being selectively coupled to a large diametered groove and a small diametered groove.

Preferably, but not necessarily, locking may be implemented in such a manner that an outer pin and an inner pin are simultaneously moved by a positive torque transmitted from the cam shaft during a normal engine operational state for being coupled to the locking groove.

Advantageous Effect of the Disclosure

The present disclosure thus configured has an advantageous effect in that a rotor is embedded with a hydraulic control valve configured to operate a phase angle control by supplying a working fluid to a vane of the rotor and a locking pin member to make responsiveness accurate due to smaller loss of the working fluid, and the hydraulic control valve is switched to various positions in response to engine operational states to control supply and discharge of the working fluid, to realize locking and releasing operations of the locking pin member with high reliability, and to improve the engine performance by adjusting the valve timing.

BRIEF DESCRIPTION OF THE DRAWINGS

Accompanying drawings are included to provide a further understanding of arrangements and embodiments of the present disclosure and are incorporated in and constitute a part of this application. In the following drawings, like reference numerals refer to like elements and wherein:

FIG. 5(*b*) is similar to FIG. 5(*a*) illustrating a state of a phase angle control operation being operable when a locking state of locking pin member of vane positioned at the full advance phase angle position is released.

DETAILED DESCRIPTION

Figure 1:
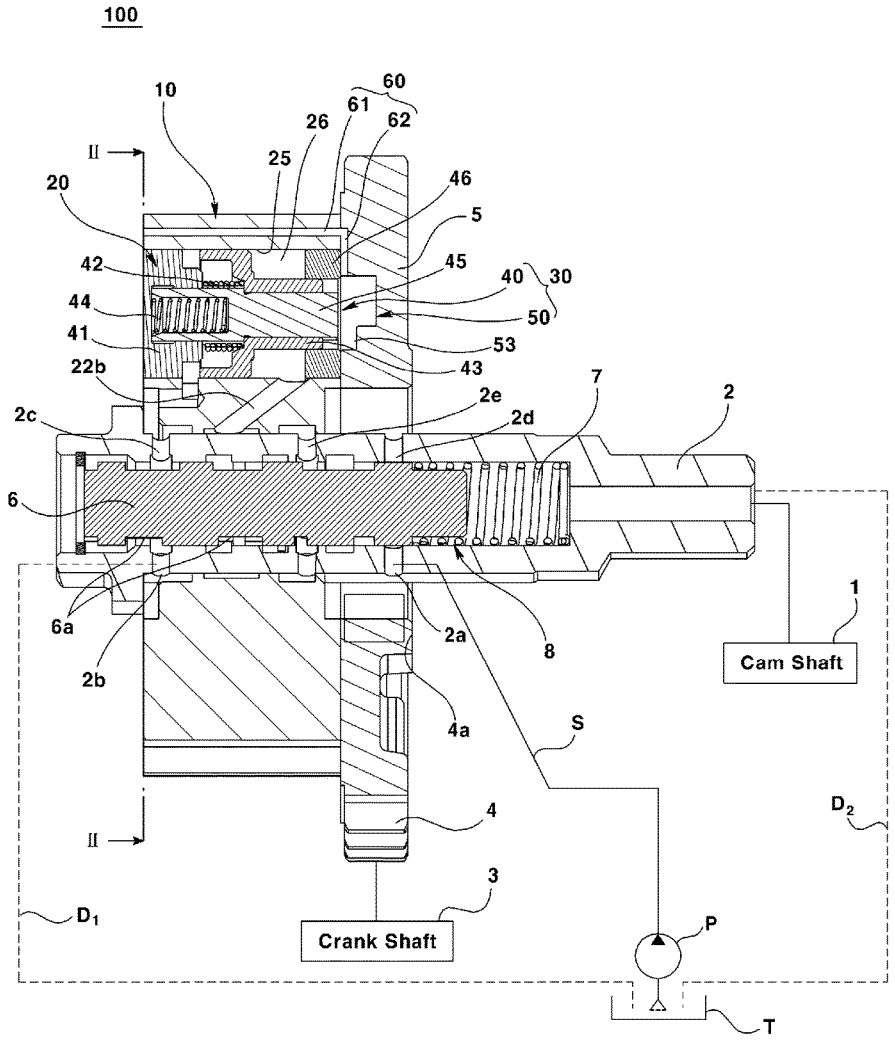
FIG. 1 is a schematic structural view illustrating an apparatus of adjusting valve timing for internal combustion engine according to an exemplary embodiment of the present disclosure.

Hereinafter, exemplary embodiments of the present disclosure are described in detail with reference to the accompanying drawings. In the drawings, sizes, relative dimensions, position relationship, or shapes of constituent elements may be artificially combined, enlarged or exaggerated for clarity and convenience.

FIG. 1 is a schematic structural view illustrating an apparatus (100) of adjusting valve timing for internal combustion engine according to an exemplary embodiment of the present disclosure.

The apparatus (100) of adjusting valve timing for internal combustion engine (hereinafter referred to as "apparatus of adjusting valve timing, or simply as "apparatus") may be configured in such a manner that a valve body (2) connected to a cam shaft (1) of the internal combustion engine is extensively formed, a sprocket (4) connected to the a crank shaft (3) via a chain (not shown) or a timing belt is rotatably coupled at a periphery of the valve body (2), and a disk-shaped ratchet plate (5) is coupled to an outside (4*a*) of the sprocket (4).

The valve body (2) interlocking with the cam shaft (1) may be embedded with a hydraulic control valve (8) in which a spool (6) formed at a periphery with a plurality of oil grooves (6*a*) is elastically mounted by a spring (7) to switch and control flow of working fluid in response to a solenoid (V) being applied with a control signal of a controller (not shown).

Figure 3:
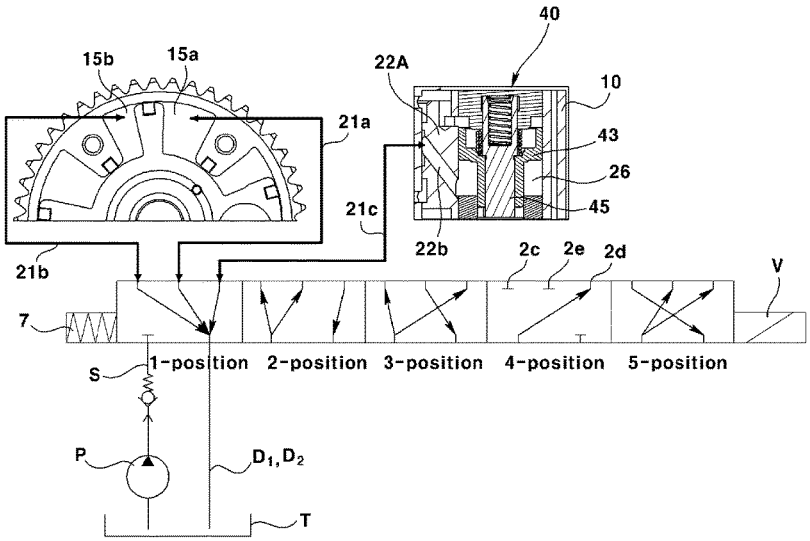
FIG. 3 is a schematic conceptual view explaining a method of adjusting valve timing for internal combustion engine according to an exemplary embodiment of the present disclosure.

Referring to FIGS. 1 and 3, the hydraulic control valve (8) is a 5-point 5-position valve configured to control supply and discharge of working fluid to the apparatus (100) by being connected via a supply passage (S) and drain passages (D1, D2) between a fluid pump (P) and a drain tank (T).

In FIG. 3, 1-position is a position to control working fluid when an engine is stopped or started, 2-position is a position to control the working fluid when an engine is in an idling operation state, and 3, 4, 5-positions are positions to control the working fluid when an engine is in a normal operation to perform the phase control of the valve timing. The 3-position indicates an advance phase angle operation control, 4-position indicates a hold control when the locking state is completely released, and 5-position indicates a retard phase angle operation control.

Meantime, a valve body (2) adjacent to a periphery of spool (6) may be formed with an inlet port (2*a*) connected to fluid pump (P) via a supply passage (S), and an outlet port (2*b*) connected to a drain tank (T) via the drain passages (D1, D2). Furthermore, the valve body (2) may be respectively formed with an advance port (2*c*) respectively connected to an advance chamber (described later) or to a retard chamber (described later), a retard port (2*d*) and a locking port (2*e*) interlocking with a locking chamber (described later).

Meantime, the valve body (2) may be coupled with a cylindrical housing (10), a rotor (20) interlocking with the cam shaft (1) and coupled at an inside space of the housing (10) in a relative rotational manner, and a rotation prevention means (30) allowing the rotor (1) to rotate with the housing (10) by restricting the relative rotation of the rotor (20) relative to the housing (10).

The inner surface (11) of the housing (10) may be protrusively formed with a plurality of protruding portions (12) each spaced apart at a predetermined distance. Each protruding portion (12) may be formed at an upper end thereof with a hermetic groove (13) to a lengthwise direction of the housing (10), where the hermetic groove (13) may be formed with a space (14) between adjacent protruding portions (12) by allowing a hermetic seal (14) to be inserted into the hermetic groove (13).

Figure 2:
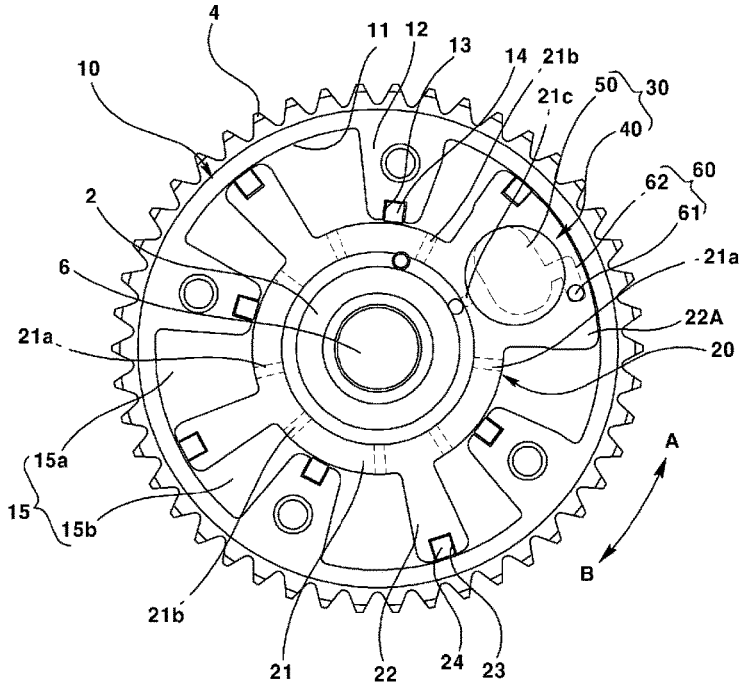
FIG. 2 is a front view taken along line II-II of FIG. 1.

Meantime, referring to FIG. 2, the rotor (20) may be configured in such a manner that a plurality of vanes (22) is protrusively formed at a boss portion (21) coupled to the body (2) toward the inner surface (11) of the housing (10). The each vane (22) may be formed at an upper end with a hermetic groove (23) to a lengthwise direction of the rotor (20), and a hermetic seal (24) may be inserted to the hermetic groove (23) to allow forming a space (15) between adjacent protruding portions (12) of the housing (10).

Referring to FIG. 2, the space (15) may be divided, about the vane (12), into a retard chamber (15*a*) to an arrow B direction (i.e., advance direction) which is a rotation direction of the cam shaft (1), and an advance (15*b*) to an arrow A direction (i.e., retard direction).

Meantime, a boss portion (21) may be formed with an advance fluid passage (21*a*) supplying the working fluid via interlock with the advance port (2*c*) and the retard chamber (15*a*), a retard fluid passage (21*b*) supplying working fluid via interlock with the retard port (2*d*) and the advance chamber (15*b*), and a locking passage (21*c*) supplying the working fluid via interlock with the locking port (2*e*) and a locking chamber (described later).

Thus, when fluid pressure is applied to the vane (12) by allowing the working fluid to be selectively supplied to the retard chamber (15*a*) or to the advance chamber (15*b*) through the advance fluid passage (21*a*) or to the retard fluid passage (21*b*), the rotor (20) is rotated to the arrow B direction (advance direction) relative to the housing (10) to adjust the advance phase, or conversely to the arrow B direction (retard direction) to adjust the retard phase, whereby the valve timing of the intake valve or the exhaust valve can be adjusted.

Meantime, the rotation prevention means (30) may be formed for emergency operation in order to prevent a relative rotation between the rotor (20) and the housing (10) resulted from an external cause and to interlock the rotor (20) and the housing (10) during the rotor (20) is freely and relatively rotated relative to the housing (10) to adjust the phase.

In other words, as illustrated in FIG. 2 through an exemplary embodiment of the present disclosure, the rotation prevention means (30) may be installed at any one of the vanes (12). Here, for the convenience of explanation, a vane (22) mounted with the rotation prevention means (30) may be differentiated from other vanes (22) by marking with reference numeral 22A.

Referring to FIGS. 1 and 2, the rotation prevention means (30) may include a locking pin member (40) inserted into a mounting hole (25) penetratively formed at the vane (22A), and a plurality of locking grooves (50) formed at a ratchet plate (5) to allow a locking operation or a locking release by being mutually coupled with the locking pin member (40).

Here, the locking pin member (40) may include an upper cap (41) closing one end (a left end in FIG. 1) of the mounting hole (25), an hollow cylinder-shaped outer pin (43) elastically mounted via an outer spring (42) at a bottom end of the upper cap (41), and an inner pin (45) elastically mounted by an inner spring (44) relative to the upper cap (41) while being slidingly coupled at an inside of the outer pin (43).

The locking pin member (40) may further include a ring-shaped bottom cap (46) supporting a periphery of the outer pin (43) while closing the other end (right end in FIG. 1) of the mounting hole (25).

Furthermore, the vane (22A) may be penetratively formed with a locking passage (22*b*) supplying the working fluid from the mounting hole (25) to the locking chamber (26) about the outer pin (43) or discharging the working fluid.

Figure 4A:
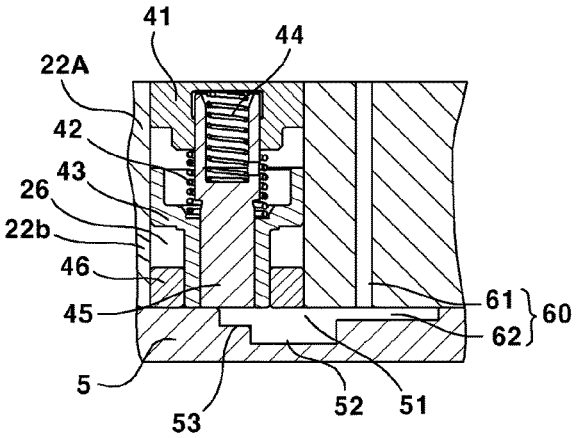
FIGS. 4(*a*)-4(*c*) are cross-sectional views each illustrating an operation in which a locking pin member of a vane positioned at a full retard phase angle position is coupled to a locking groove in turn by a negative torque according to an exemplary embodiment of the present disclosure.
Figure 4B:
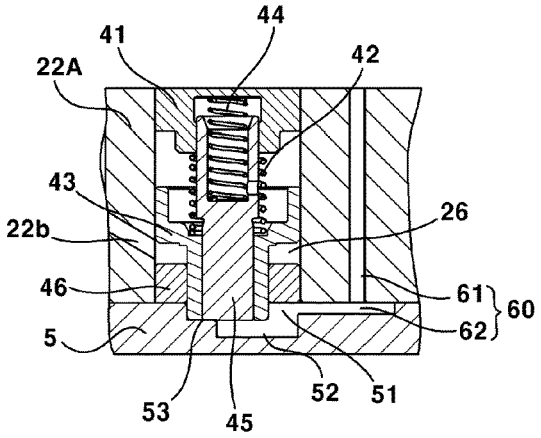
Figure 4C:
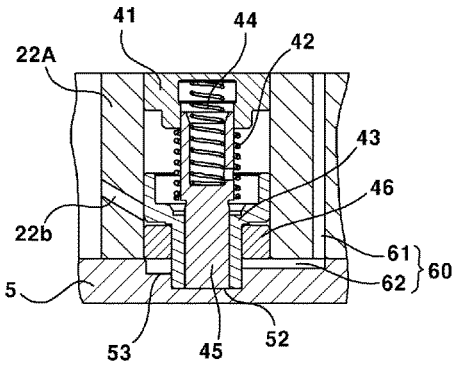

Meantime, as illustrated in FIGS. 4(*a*)-4(*c*), the plurality of locking grooves (50) formed at the ratchet plate (5) forming the rotation prevention means (30) may be connectively formed in a plural number each having a different depth and diameter by being opposite to the mounting hole (25) of the vane (25A). That is, the locking groove (50) may be configured in such a manner that a large diametered groove (51) and a small diametered groove (52) are connected to form a cross-sectionally shaped staircase portion (53).

However, as a modification of the present disclosure, the locking groove (50) comprised of the large diametered groove (51) and the small diametered groove (52) may be formed at the housing (10).

Meantime, the apparatus may include a drain passage (60) closed at the time of phase adjusting operation of the locking pin member (40) and discharging the working fluid of the locking groove (50) to outside at the time of locking. As illustrated in FIGS. 1 and 2, the drain passage (60) may include a first drain hole (61) formed at the ratchet plate (5) in order to communicate with the locking groove (50), and a second drain hole (62) connected to the outside by going through the vane (22A) while being connected to the first drain hole (61).

Here, however, unlike actual scales or cross-sections, sizes and relative positions of locking groove (50), the first drain hole (61) and the second drain hole (62) may be artificially combined, enlarged or exaggerated for convenience of explanation of mutually interlocking relationship in response to the operation of the locking pin member (40).

Now, operation of the valve timing adjusting apparatus thus configured according to an exemplary embodiment of the present disclosure will be explained.

When startability is improved by allowing the apparatus to operate to a predetermined position without a separate control during stop or start of an engine or when an emergency situation of impossibility to control occurs during operation of an engine, the locking pin member (40) must be self-locked without a separate control to thereby prevent a relative rotation of the rotor (20) to the housing (10).

When an engine is to be stopped or emergently stopped, a hydraulic control valve (8) is positioned at a 1-position as illustrated in FIG. 2 in response to a control signal of a controller (not shown).

Thus, the supply passage (S) of the fluid pump (P) is interrupted, and working fluid of all the retard chamber (15*a*), the advance chamber (15*b*) and the locking chamber (26) is connected to the drain tank (T) through the ports (21*a*, 21*b*, 21*c*) via the drain passages (D1, D2). For example, when the hydraulic control valve (8) is changed to a 1-position in FIG. 2 while the vane (22A) is positioned at the full retard phase angle, the vane (22A) is rotate to a predetermined angle by a negative torque from the cam shaft (1).

At this time, the locking performance can be decreased because working fluid remaining at the retard chamber (15*a*) and the advance chamber (15*b*) act as resistance. In addition, when the negative torque is applied, working fluid charged in the advance chamber (15*b*) acts as resistance, and working fluid in the retard chamber (15*a*) acts as resistance by being applied with static pressure.

Under this state, when the hydraulic control valve (8) is switched to 1-position in FIG. 2, the retard chamber (15*a*) and the advance chamber (15*b*) are connected to the drain tank (T). As a result, a negative pressure is removed by introduction of outside air to the advance chamber (15*b*) and a positive pressure applied to the retard chamber (15*a*) is removed by discharge of the working fluid. This state is illustrated in FIG. 4(*a*).

That is, the outer pin (43) and the inner pin (45) respectively descend due to elasticity of the springs (42, 44) as the pressure of the working fluid is released. At this time, a bottom end of the outer pin (43) and the inner pin (45) is in a close contact with a surface of the ratchet plate (5) to allow the self-locking operation to start.

In the FIG. 4(*a*) state, when a negative torque is transmitted to the vane (22A) through the cam shaft (1) via the rotor (20), the vane (22A) is rotated to an advance direction (B direction) at a predetermined angle. Thus, only the inner pin (45) alone may be descended by elasticity of the inner spring (44), or the outer pin (43) is also descended by elasticity of the outer spring (42) to be inserted into the large diametered groove (51) to allow a bottom end to be in a close contact with the staircase portion (53), the state of which is illustrated in FIG. 4(*b*).

Thus, all the outer pin (43) and the inner pin (45) are hitched at a left wall portion of the large diametered groove (51) at a bottom end whereby the vane (22A) becomes in a ratchet operation of being immovable to a retard direction.

Part of the working fluid charged in the locking groove (50) under this operation process is discharged to outside because of the drain passage (60), i.e., the first and second drain holes (61, 62), being partially communicated, whereby there is applied no resistance to the locking operation.

Successively, when an additional negative torque is applied to the vane (22A) via the rotor (20) through the cam shaft (1), only the inner pin (45) alone may be descended by elasticity of the inner spring (44), or the outer pin (43) is also descended by elasticity of the outer spring (42) to be inserted into the small diametered groove (52). At this time, the working fluid inside the locking groove (50) is discharged to the outside because the first and second drain holes (61, 62) are completely communicated as illustrated in FIG. 2. Thus, a bottom end of the outer pin (43) is in a close contact with a floor surface of the small diametered groove (52), the state of which is illustrated in FIG. 4(*c*).

Here, the bottom end of the outer pin (43) is hitched at a right wall portion of the large diametered groove (51) and at left and right wall portions of the small diametered groove (52) whereby the vane (22A) becomes in a locked state in which the vane cannot move to any direction of advance direction or the retard direction. As a result, the locking pin member (40) becomes securely coupled to the locking groove (50) of the ratchet plate (5), and the rotor (20) can simultaneously be rotated with the housing while the relative rotation is prevented relative to the housing (10).

Next, an explanation will be provided where a self-locking operation is realized using a positive torque of the cam shaft (1) while the vane (22A) is in a lopsided position to an advance position, i.e., to a retard chamber (15*a*) side, in the space (15).

Meantime, a positive torque is generally greater than a negative torque, such that, in the exemplary embodiment of the present disclosure, a self-locking operation is realized at one time, and an applied direction of positive torque acting on the vane (22A) becomes A direction, which is a direction opposite from that (B direction) of negative torque.

That is, when the positive torque is applied to allow the vane (22A) to rotate to A direction at a predetermined angle, the outer pin (43) and the inner pin (45) of the locking pin member (40) pass the large diametered groove (51) of the locking groove (50) at one time to be inserted into the small diametered groove (52) and to be locked, the state of which is illustrated in FIG. 4 (*c*).

Meantime, when a predetermined time is passed after an engine is started to make the engine to idle, the hydraulic control valve (8) is switched to a 2-position by a control signal of the controller as illustrated in FIG. 3, which is set to allow the said state to be maintained for a minimum time after start of engine at an initial stable section. That is, a predetermined time is required up to a complete charge because the working fluid is not completely charged in the retard chamber (15*a*) and the advance chamber (15*b*) during the initial starting state of engine.

At this time, although the hydraulic control valve (8) is in a 2-position of FIG. 3 to allow the working fluid to be supplied to the retard chamber (15*a*) and the advance chamber (15*b*) from the fluid pump (P), the locking pin member (40) maintains the locked state as in FIG. 4 (*c*) because the locking chamber (26) is connected to the drain tank (T) via the drain passages (D1, D2).

Meantime, when an engine is started to be in a normal operation, the valve timing of intake valve or the exhaust valve must be adjusted and therefore, the locked state of the locking pin member (40) of FIG. 4 (*c*) must be released.

To this end, the hydraulic control valve (8) is switched to a 4-position of FIG. 3 by a control signal of the controller. Thus, the supply of working fluid to the retard chamber (15*a*) and the advance chamber (15*b*) from the fluid pump (P) is blocked and the working fluid is supplied to the locking chamber (26) sequentially passing through the locking port (2*e*), the locking passage (21*c*) and the oil passage (22*b*).

As a result, the outer pin (43) and the inner pin (45) respectively press the springs (42, 44) in response to the pressure of the working fluid and become lying in a maximally raised state relative to the upper cap (41). At this time, the bottom part of the inner pin (45) is in a tightly contacted state with a surface of the ratchet plate (5) by the elasticity of the inner spring (44), the state of which is respectively shown in FIGS. 5(*a*) and 5(*b*).

Figure 5A:
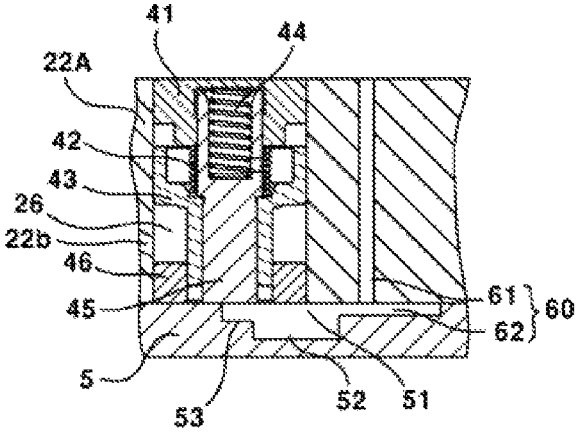
FIG. 5(*a*) is a cross-sectional view illustrating a state of a phase angle control operation being operable when a locking state of locking pin member of vane positioned at the full advance phase angle position is released.
Figure 5B:
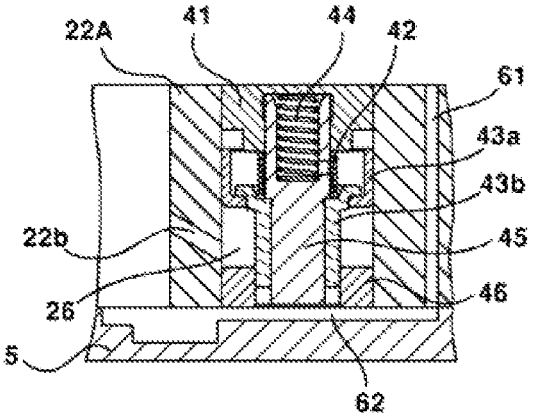

Here, FIG. 5 (*a*) illustrates a case where the vane (22A) mounted with the locking pin member (40) is in a position of full advance phase angle position, and FIG. 5(*b*) illustrates a case where the vane (22A) mounted with the locking pin member (40) is in a position of full retard phase angle position.

Thus, the vane (22A) mounted with the locking pin member (40) can be rotated between the retard chamber (15*a*) and the advance chamber (15*b*) to adjust the valve timing of the intake valve or the exhaust valve by means of the torque acting on the vane (12) from the cam shaft (1).

First of all, when the hydraulic control valve (8) is switched to a 3-position of FIG. 3 by the control signal of the controller, the advance control operation starts. That is, the working fluid is supplied to the advance chamber (15*b*) while the working fluid is supplied from the fluid pump (P) to the locking chamber (26), and the retard chamber (15*a*) is connected to the drain tank (T) to allow the working fluid to be discharged. Thus, the vane (22) is freely controlled to the advance direction (B direction) or to the retard direction (A direction) relative to the housing (10) in response to the negative torque or the positive torque through the cam shaft (1) to adjust the valve timing of the intake valve or the exhaust valve via the cam shaft (1).

Meantime, when the hydraulic control valve (8) is switched to a 5-position of FIG. 3 by the control signal of the controller, the retard control operation starts.

That is, the working fluid is supplied to the retard chamber (15*a*) while the working fluid is supplied from the fluid pump (P) to the locking chamber (26), and the advance chamber (15*b*) is connected to the drain tank (T) to allow the working fluid to be discharged. Thus, the vane (22) is freely controlled to the advance direction (B direction) or to the retard direction (A direction) relative to the housing (10) in response to the negative torque or the positive torque through the cam shaft (1) to adjust the valve timing of the intake valve or the exhaust valve via the cam shaft (1).

As explained from the foregoing, the exemplary embodiment of the present disclosure is such that the hydraulic control valve is embedded in the rotor to reduce the loss of working fluid, and the responsiveness becomes accurate, locking and releasing operations of the locking member can be realized with high reliability by employing the hydraulic control valve having various control positions, and the engine performance can be improved by adjusting valve timing.

The above description has explained the exemplary embodiments of the present disclosure, and the present disclosure is not limited thereto. Thus, it should be interpreted that as those skilled in the art will realize, the described embodiments may be modified or changed in various different ways, all without departing from the spirit or scope of this disclosure.

For example, although the exemplary embodiments of the present disclosure have explained that the rotor (20) is mounted with four vanes (22), the number of vanes (22) may be selectively designed to the number of three or other number in response to the types of engine or the operational characteristics of the engine.

Furthermore, although the exemplary embodiments of the present disclosure have explained that the vane (22A) mounted with the locking pin member (40) is only one, it may be that two vanes (22A), each mounted with the locking pin member (40), are configured on the rotor (20).

In addition, as illustrated in FIG. 5(*b*), as a modification of the present disclosure, the outer pin may be separated to upper and bottom parts to be divided to the upper ring (43*a*) and the bottom ring (43*b*), whereby accumulated tolerance can be applied to a periphery of the upper ring (43*a*) to thereby mitigate the tolerance control of the locking pin member (40).

Meantime, although the exemplary embodiments of the present disclosure have explained the rotor (20) mounted with the locking pin member (40) and the rotation prevention means (30) formed with a locking groove (50) on the ratchet plate (5), an alternative configuration may be designed that the rotor (20) is formed with the locking groove and the ratchet plate (5) or the housing (10) is mounted with the locking pin member (40).

What is claimed is:

1. A valve timing adjusting apparatus for internal combustion engine, the apparatus comprising:

a housing having an inner space while interlocking with a crank shaft;

a rotor having a plurality of vanes, each vane forming an advance chamber in a direction of adjusting an advance phase angle and a retard chamber in a direction of adjusting a retard phase angle, and each vane mounted at the inner space of the housing while being interlocked with a cam shaft;

at least one locking groove formed in the housing, each locking groove formed at a different depth;

a locking pin member configured to be coupled in the at least one locking groove and including a hollow outer pin elastically mounted at a locking chamber formed at the vane, and an inner pin elastically mounted at an inside of the outer pin;

a drain passage configured to discharge working fluid of the at least one locking groove to outside; and a hydraulic control valve mounted at an inside of the rotor to supply the working fluid to or discharge the working fluid from the advance chamber, the retard chamber, or the locking chamber in response to an operation state of engine, and connected to a working fluid pump in order to control operation of the locking pin member, wherein the outer pin and the inner pin are configured to be sequentially or simultaneously coupled to the at least one locking groove by a torque transmitted from the cam shaft to prevent rotation of the rotor against the housing while adjusting a valve timing at an intermediate position between a full advance phase angle position and a full retard phase angle position of the rotor.

2. The apparatus of claim 1, wherein the at least one locking groove comprises a large diametered groove and a small diametered groove connected to the large diametered groove to allow the locking pin member to be coupled.

3. The apparatus of claim 2, wherein the at least one locking groove is formed with a staircase portion by allowing the large diametered groove with a large diameter and the small diametered groove with a smaller diameter to be formed each at a predetermined depth.

4. The apparatus of claim 1, wherein the drain passage is:

interrupted when a phase angle adjustment of the locking pin member is operated; and open to discharge the working fluid of the at least one locking groove to the outside when the at least one locking pin member is locked.

5. The apparatus of claim 4, wherein the drain passage includes a first drain hole formed in the vane and connected to the outside through the vane, and a second drain hole formed in the housing and connected to the at least one locking groove by communicating with the first drain hole.

6. The apparatus of claim 1, wherein the hydraulic control valve includes a 5-port 5-position valve configured to selectively supply or discharge the working fluid through passages each connected to the advance chamber, the retard chamber, and the locking chamber.

7. The apparatus of claim 6, further comprising a check valve disposed at a supply passage of the working fluid pump and configured to prevent backflow between the hydraulic control valve and the working fluid pump.

8. The apparatus of claim 1, wherein the outer pin is divided into an upper ring and a bottom ring separated from the upper ring.

9. A method of adjusting valve timing for internal combustion engine including a housing having an inner space while interlocking with a crank shaft; a rotor having a plurality of vanes, each vane forming an advance chamber in a direction of adjusting an advance phase angle and a retard chamber in a direction of adjusting a retard phase angle, and each vane mounted at the inner space of the housing while being interlocked with a cam shaft; and a locking pin member including a hollow outer pin elastically mounted at a locking chamber formed at the vane, and an inner pin elastically mounted at an inside of the outer pin, and preventing rotation of the rotor by being coupled to the housing using a torque transmitted from the cam shaft while adjusting a valve timing at an intermediate position between a full advance phase angle position and a full retard phase angle position of the rotor, the method comprising:

discharging working fluid of the advance chamber, the retard chamber, and the locking chamber when the engine is in a stationary state;

supplying the working fluid to the advance chamber and the retard chamber and discharging the working fluid of the locking chamber during an idling rotation state of the engine; and supplying the working fluid to the locking chamber and selectively supplying the working fluid to the advance chamber or to the retard chamber during a normal engine operational state.

10. The method of claim 9, wherein the engine further includes a drain passage, the method further comprising:

interrupting, by the drain passage, the supply of the working fluid to the advance chamber and the retard chamber during the normal engine operational state; and supplying, by the drain passage, the working fluid only to the locking chamber during the normal engine operational state.

11. The method of claim 9, wherein:

the engine further includes a hydraulic control valve; and the hydraulic control valve includes a 5-port 5-position valve configured to selectively supply or discharge the working fluid through passages each connected to the advance chamber, the retard chamber, and the locking chamber.

12. The method of claim 9, wherein locking is implemented in such a manner that the outer pin and the inner pin are sequentially moved by a negative torque transmitted from the cam shaft during the normal engine operational state for being selectively coupled to a large diametered groove and a small diametered groove.

13. The method of claim 9, wherein:

the engine further includes a locking groove formed in the housing; and locking is implemented in such a manner that the outer pin and the inner pin are simultaneously moved by a positive torque transmitted from the cam shaft during the normal engine operational state for being coupled to the locking groove.

14. The method of claim 13, wherein the positive torque is greater than a negative torque transmitted from the cam shaft.

15. A method of adjusting valve timing for internal combustion engine including a housing having an inner space while interlocking with a crank shaft; a rotor having a plurality of vanes, each vane forming an advance chamber in a direction of adjusting an advance phase angle and a retard chamber in a direction of adjusting a retard phase angle, and each vane mounted at the inner space of the housing while being interlocked with a cam shaft; and a locking pin member including a hollow outer pin elastically mounted at a locking chamber formed at the vane, and an inner pin elastically mounted at an inside of the outer pin, and preventing rotation of the rotor by being coupled to the housing while adjusting a valve timing, the method comprising:

discharging working fluid of the advance chamber, the retard chamber, and the locking chamber when the engine is in a stationary state;

supplying the working fluid to the advance chamber and the retard chamber and discharging the working fluid of the locking chamber during an idling rotation state of the engine;

providing a torque by being transmitted from the cam shaft; and supplying the working fluid to the locking chamber and selectively supplying the working fluid to the advance chamber or to the retard chamber during a normal engine operational state.

16. The method of claim 15, wherein the torque is provided while adjusting a valve timing at an intermediate position between a full advance phase angle position and a full retard phase angle position of the rotor.

17. The method of claim 15, wherein the engine further includes a drain passage, the method further comprising:

interrupting, by the drain passage, the supply of the working fluid to the advance chamber and the retard chamber during the normal engine operational state; and supplying, by the drain passage, the working fluid only to the locking chamber during the normal engine operational state.

18. The method of claim 17, wherein:

the engine further includes a hydraulic control valve; and the hydraulic control valve includes a 5-port 5-position valve configured to selectively supply or discharge the working fluid through passages each connected to the advance chamber, the retard chamber, and the locking chamber.

19. The method of claim 16, wherein the torque is a negative torque transmitted from the cam shaft during the normal engine operational state to sequentially move the outer pin and the inner pin to be selectively coupled to a large diametered groove and a small diametered groove.

20. The method of claim 19, wherein the negative torque is smaller than a positive torque transmitted from the cam shaft during the normal engine operational state.

* * * * *